United States Patent [19]

Isogai et al.

[11] Patent Number: 4,967,701

[45] Date of Patent: Nov. 6, 1990

[54] VALVE TIMING ADJUSTER

[75] Inventors: Kimiyoshi Isogai, Hekinan; Shinji Ishida, Chiryu; Toshinobu Nishi, Obu; Hidenori Sato, Kariya; Kenji Yamada, Aichi, all of Japan

[73] Assignee: Nippondenso Co., Ltd., Kariya, Japan

[21] Appl. No.: 462,401

[22] Filed: Jan. 9, 1990

[30] Foreign Application Priority Data

Jan. 12, 1989 [JP] Japan ..... 1-005516
Oct. 12, 1989 [JP] Japan ..... 1-265681

[51] Int. Cl.[5] ..... F01l 9/04; F01l 1/34

[52] U.S. Cl. ..... 123/90.11; 123/90.17; 123/90.31

[58] Field of Search ..... 123/90.11, 90.15, 90.17, 123/90.31, 500, 501, 507, 508; 464/2, 29

[56] References Cited

U.S. PATENT DOCUMENTS

| | | | |
|---|---|---|---|
| 3,978,829 | 9/1976 | Takahashi et al. | 123/90.17 |
| 4,231,330 | 11/1980 | Garcea | 123/90.15 |
| 4,305,352 | 12/1981 | Oshima et al. | 123/501 |
| 4,452,188 | 6/1984 | Kosuda et al. | 123/90.18 |
| 4,494,496 | 1/1985 | Nakamura et al. | 123/90.17 |
| 4,561,390 | 12/1985 | Nakamura et al. | 123/90.17 |
| 4,754,727 | 7/1988 | Hampton | 123/90.17 |
| 4,825,992 | 5/1989 | Skrobisch | 464/29 |

FOREIGN PATENT DOCUMENTS

| | | |
|---|---|---|
| 61-268810 | 11/1986 | Japan . |
| 64-3207 | 1/1989 | Japan . |

*Primary Examiner*—David A. Okonsky
*Assistant Examiner*—Weilun Lo
*Attorney, Agent, or Firm*—Cushman, Darby & Cushman

[57] ABSTRACT

A valve timing adjuster according to the present invention, comprises a pulley rotationally connected to one of an output shaft of engine and a cam shaft, a sleeve which is supported on the pulley, which is rotatable within a predetermined angle of rotation on the pulley and which is rotationally connected to the other one of the output shaft of engine and the cam shaft, an electromagnet mounted on one of the pulley and the sleeve, an armature mounted on the other one of the pulley and the sleeve so that magnetic flux including a magnetic flux component extending in the circumferential direction of the valve timing adjuster is generated, the armature is drawn by the magnetic flux toward the electromagnet and the sleeve is rotated within the predetermined angle of rotation on the pulley when the electromagnet is energized, and a control device which controls the operation of electromagnet so that the phase difference between the cam shaft and the output shaft is suitably adjusted during operation of a vehicle. Since the valve timing adjuster according to the present invention does not need means for converting an axial movement of the pulley to a circumferential or rotational movement thereof, does not have many friction regions and does not have the hydraulically-operated actuator and the hydraulic pipe lines, the durability and response speed are increased and the cost of modification of engine is not needed.

11 Claims, 9 Drawing Sheets

VALVE TIMING ADJUSTER

BACKGROUND OF THE INVENTION AND RELATED ART STATEMENT

The present invention relates to a valve timing adjuster for changing phase difference between a cam shaft and an output shaft during operation of an engine.

A valve timing adjuster disclosed in Japanese Patent Unexamined Publication No. 61-268810 has a ring gear whose radially inner periphery and radially outer periphery include respective sets of teeth at least one set of which is composed of helical teeth, a pulley which engages with the teeth of outer periphery of the ring gear and which is driven by an engine and a cam shaft which engages with the teeth of inner periphery of the ring gear, wherein the ring gear is moved axially by a hydraulically-operated actuator so that the pulley rotates on the cam shaft. In the conventional valve timing adjuster, the helical teeth slide on the teeth engaging therewith in the longitudinal direction of teeth for rotating the pulley on the cam shaft. Therefore, a great frictional force is generated between the teeth engaging with each other.

Since the hydraulically-operated actuator has an oil chamber, a small time lag is needed in order that the pressure of oil chamber reaches a predetermined degree. Therefore, the response speed of conventional valve timing adjuster is low.

Furthermore, since the conventional valve timing adjuster includes many friction regions, for example, between the herical teeth engaging with each other and in the hydraulically-operated actuator, the durability of valve timing adjuster is low.

Furthermore, since pipe lines are mounted on the engine to feed hydraulic oil from a hydraulic source to the hydraulically-operated actuator, the engine must be modified and the cost of product becomes high.

OBJECT AND SUMMARY OF THE INVENTION

The object of the present invention is to provide a valve timing adjuster whose response speed and durability are high and whose cost is low.

According to the present invention, a valve timing adjuster comprises a pulley rotationally connected to one of an output shaft of engine and a cam shaft, a sleeve which is supported on the pulley, which is rotatable within a predetermined angle of rotation on the pulley and which is rotationally connected to the other one of the output shaft of engine and the cam shaft, an electromagnet mounted on one of the pulley and the sleeve, an armature mounted on the other one of the pulley and the sleeve so that magnetic flux including a magnetic flux component extending in the circumferential direction of the valve timing adjuster is generated, the armature is drawn by the magnetic flux toward the electromagnet and the sleeve is rotated within the predetermined angle of rotation on the pulley when the electromagnet is energized, and a control device which controls the operation of electromagnet so that the phase difference between the cam shaft and the output shaft is suitably adjusted during operation of a vehicle.

In an embodiment of the present invention, the armature has an armature front surface extending in the circumferential direction of the valve timing adjuster and the electromagnet has an electromagnet front surface extending in the circumferential direction of the valve timing adjuster. The armature front surface and the electromagnet front surface closely face to each other in the radial direction of the valve timing adjuster, and the area of at least one of the armature front surface and the electromagnet front surface is small in comparison with the degree of magnetic flux generated by the electromagnet so that a difference between the generated magnetic flux density and the saturation magnetic flux density is small on at least one of the armature front surface and the electromagnet front surface and a part of magnetic flux including a magnetic flux component extending not in the radial direction of the valve timing adjuster but in the circumferential direction of the valve timing adjuster is increased.

According to the present invention, since the electromagnet is mounted on one of the pulley and the sleeve, and the armature is mounted on the other one of the pulley and the sleeve so that magnetic flux including a magnetic flux component extending in the circumferential direction of the valve timing adjuster is generated, the armature is drawn by the magnetic flux toward the electromagnet and the sleeve is rotated within the predetermined angle of rotation on the pulley when the electromagnet is energized, the valve timing adjuster does not need means for converting an axial movement of the pulley to a circumferential or rotational movement thereof, does not have many friction regions and does not have the hydraulically-operated actuator and the hydraulic pipe lines. Therefore, the durability and response speed are increased and the cost of modification of engine is not needed.

In an embodiment of the present invention, since the area of at least one of the armature front surface and the electromagnet front surface is small in comparison with the amount of magnetic flux generated by the electromagnet, the difference between the generated magnetic flux density and the saturation magnetic flux density is small on at least one of the armature front surface and the electromagnet front surface. Therefore, a part of the generated magnetic flux flows through a part of armature or of electromagnet other than the armature front surface or electromagnet front surface extending in the circumferential direction of the valve timing adjuster and the smaller the difference between the generated magnetic flux density and the saturation magnetic flux densith is on at least one of the armature front surface and the electromagnet front surface, the greater the amount of magnetic flux flowing through the part of armature or of electromagnet other than the armature front surface or electromagnet front surface is, so that the amount of magnetic flux including a magnetic flux component extending not in the radial direction of the valve timing adjuster but in the circumferential direction of the valve timing adjuster is increased and the amount of magnetic flux extending in the radial direction of the valve timing adjuster between the armature front surface and the electromagnet front surface is decreased. Therefore, a torque for rotating the sleeve is held large even when the sleeve and the pulley move in close to each other in the circumferential direction.

DETAILED DESCRIPTION OF PREFERRED EMBODIMENTS

Figure 1:
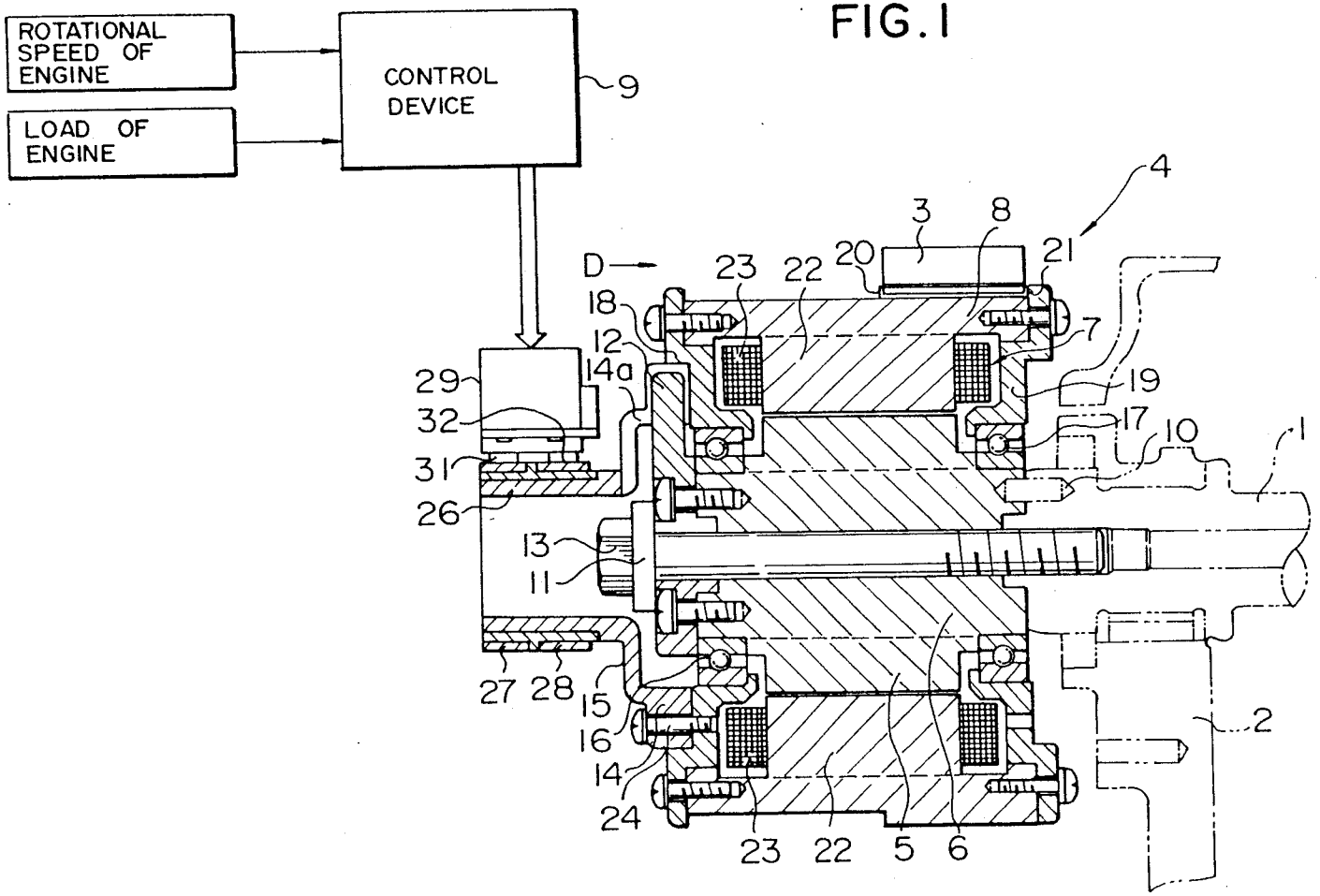
FIG. 1 is a cross-sectional view showing a valve timing adjuster according to the present invention.

In a valve timing adjuster shown in FIG. 1, phase difference between an intake cam shaft and a crank shaft is changed so that an overlap angle between intake valve timing and outlet valve timing is changed.

An intake cam shaft 1 for driving an intake valve (not shown) of a twin-cam engine and an outlet cam shaft (not shown) are supported and rotatable on a cylinder head 2.

The intake cam shaft 1 is connected to the crank shaft (output shaft, not shown) through a toothed belt 3 and the valve timing adjuster 4 so that the intake cam shaft 1 is rotationally driven by the crank shaft. The valve timing adjuster 4 changes phase difference between the intake cam shaft 1 and the outlet cam shaft as follows.

The valve timing adjuster 4 has a sleeve 6, armatures 5 mounted on the sleeve 6, a pulley 8, an electromagnet 7 mounted on the pulley 8 and a control device 9 for energizing and controlling the electromagnet 7.

The sleeve 6 is made of a magnetic material, for example, iron and is attached to an end of the intake cam shaft 1. The rotational position of the sleeve 6 is determined on the intake cam shaft 1 by a rotation preventing pin 10 embedded in both the sleeve 6 and the intake cam shaft 1. The axial position of the sleeve 6 is determined on the intake cam shaft 1 by a bolt 13 which presses axially the sleeve 6 through a washer 11 and a rotation preventing positioner 12 below mentioned. Therefore, the sleeve 6 rotates with the intake cam shaft 1.

Figure 2:
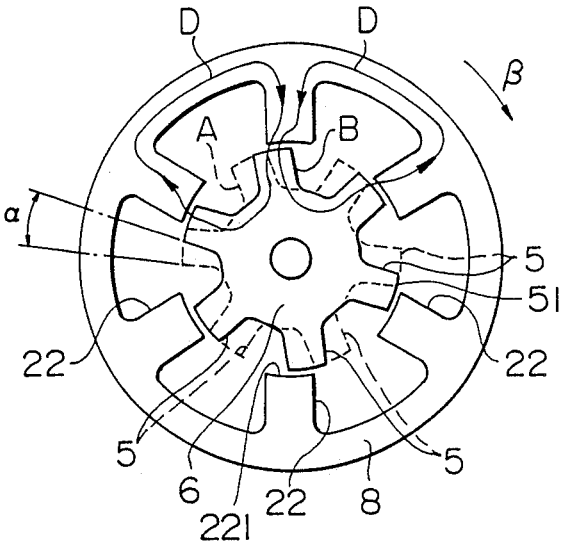
FIG. 2 is a side view showing an armature and an electromagnet used on the valve timing adjuster according to the present invention.
Figure 3:
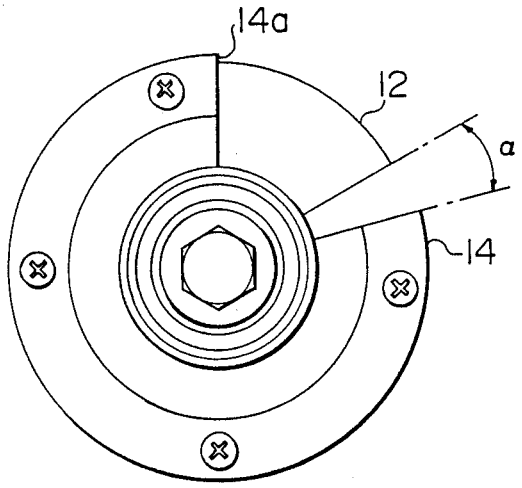
FIG. 3 is a side view showing means for limiting rotation of a sleeve.
Figure 4:
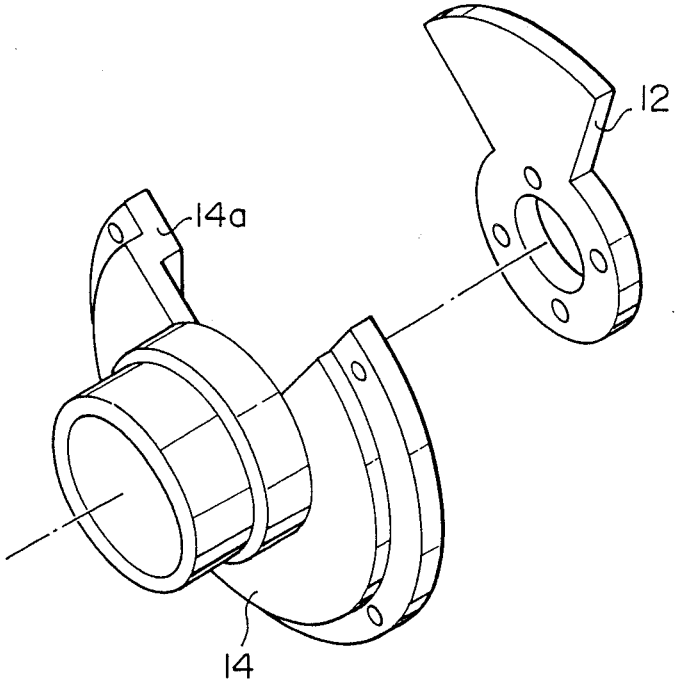
FIG. 4 is an oblique projection view showing the means for limiting rotation of the sleeve.

The plate-shaped six armatures 5 are formed integrally with an outer peripheral portion of the sleeve 6 at regular intervals in the circumferential direction as shown in FIG. 2. The armatures 5 extend radially and axially from the sleeve 6.

The rotation preventing positioner 12 cooperating with a limiting positioner 14 below described to form rotation preventing means is fixed to an end of the sleeve 6 by bolts. The fan-shaped rotation preventing positioner 12 is rotatable within a predetermined angle $\alpha$ in fan-shaped notch portion 14a of the limiting positioner 14. That is, an angle of the rotation preventing positioner 12 is smaller than that of fan-shaped notch portion 14a by $\alpha$.

The pulley 8 is also made of a magnetic material, for example, iron and has a tube-shape surrounding the sleeve 6. The pulley 8 is supported on the sleeve 6 through two bearings 16, 17 mounted on both ends of the sleeve 6 and through two extending flanges 18, 19 fixed to the pulley 8 by bolts. An outer periphery of the pulley 8 has teeth 21 engaging with teeth 20 formed on an inner surface of the toothed belt 3.

The electromagnet 7 has six iron cores 22 formed integrally with an inner peripheral portion of the pulley 8. The iron cores 22 extend axially and radially from the pulley 8 and cooperate with the armatures 5 formed integrally with the sleeve 6 as shown in FIG. 2. Gaps formed between the armatures 5 and the iron cores 22 are very small.

Electromagnet coils 23 surround the iron cores 22, respectively so that the electromagnet coils 23 cooperate with the iron cores 22 to form the electromagnet 7. In order to utilize fully magnetic flux generated by the electromagnet coils 23, the electromagnet coils 23 are connected in series and the magnetic flux generated by each of the iron cores 22 flows into adjacent ones of the iron cores 22 so that the electromagnet coils 23 adjacent to each other cooperate with each other.

The limiting positioner 14 is fixed on the extending flange 18 (left side of FIG. 1) by bolts 24 so that the limiting positioner 14 rotates together with the pulley 8. The angle of the notch portion 14a of the limiting positioner 14 is larger than that of the fan-shaped rotation preventing positioner 12 by $\alpha$ so that the fan-shaped rotation preventing positioner 12 is rotatable within in the notch portion 14a. Therefore, the sleeve is rotatable within the angle of $\alpha$ on the pulley 6.

As shown in FIG. 2, the sleeve 6 rotates behind the pulley 8 by the predetermined angle of $\alpha$ at a position shown by a broken line A when the pulley 8 is driven by the toothed belt 3 in the direction indicated by an arrow $\beta$, the electromagnet 7 is not energized and the rotation of the sleeve 6 is limited by the cooperation of the limiting positioner 14 and the rotation preventing positioner 12. And the sleeve 6 rotates without any lag from the pulley 8 at a position shown by a continuous line B when the pulley 8 is driven by the toothed belt 3 in the direction indicated by an arrow $\beta$, the electromagnet 7 is energized and the rotation of the sleeve 6 is limited by the cooperation of the limiting positioner 14 and the rotation preventing positioner 12.

The position of the sleeve 6 in the pulley 8 as shown by the broken line A is determined as follows.

Figure 5:
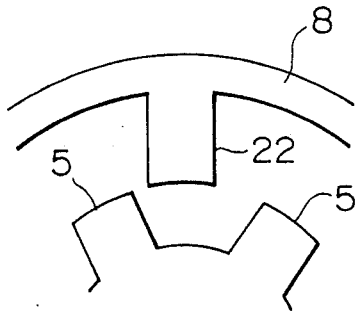
FIG. 5 is a side view showing an arrangement of armature and electromagnet.
Figure 6:
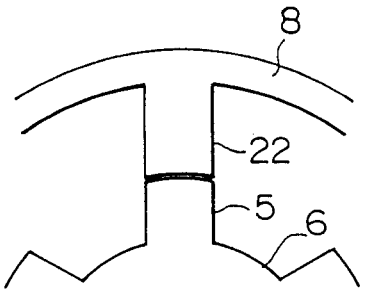
FIG. 6 is a side view showing an arrangement of armature and electromagnet.

When the iron cores 22 are largely apart from the armatures 5 (as shown in FIG. 5, when the iron cores 22 do not overlap the armatures 5) and the electromagnet coils 23 are energized, magnetic reluctances between the iron cores 22 and the armatures 5 are very large. Therefore, a magnetic force (torque) generated by the electromagnet 7 is not enough to rotate the sleeve 6. When the iron cores 22 overlap completely the armatures 5 as shown in FIG. 6 and the electromagnet coils 23 are energized, magnetic reluctances between the iron cores 22 and the armatures 5 are small but the magnetic force generated by the electromagnet 7 does not rotate the sleeve 7. Therefore, in order to rotate the sleeve 6, it is necessary that when the electromagnet coils 23 are energized, the iron cores 22 are arranged suitably near the armatures 5 respectively to make the magnetic reluctances between the iron cores 22 and the armatures 5 small and center lines of the iron cores 22 do not overlap center lines of the armatures 5, respectively.

Figure 7:
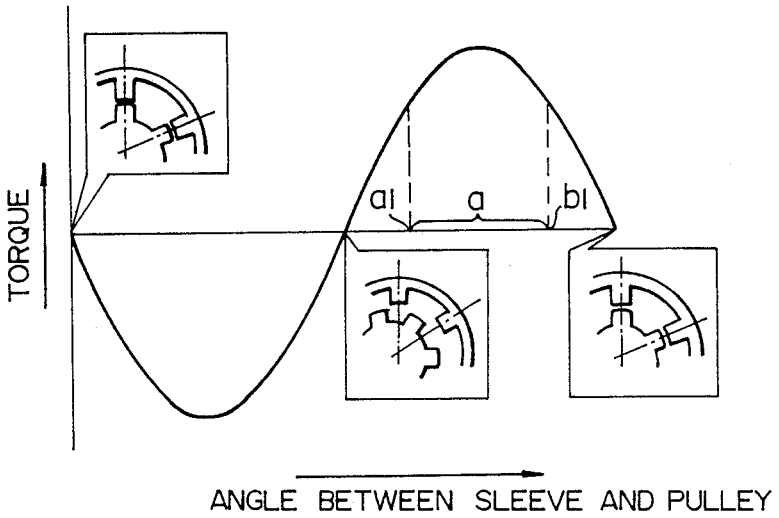
FIG. 7 is a diagram showing a relation between an angle of rotation of armature and a torque for rotating the armature.
Figure 8:
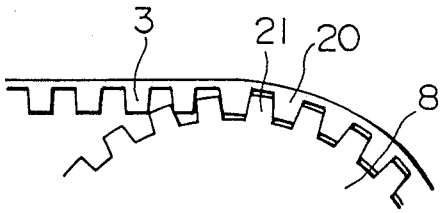
FIG. 8 is a side view in D-direction of FIG. 1.

As shown in FIG. 7, when the sleeve 6 is arranged at the position shown by the broken line A in the pulley 8 and the electromagnet 7 is energized, a magnetic force (torque) indicated by "al" acts on the armatures 5, and when the sleeve 6 is arranged at the position shown by the continuous line B in the pulley 8 and the electromagnet 7 is energized, a magnetic force (torque) indicated by "bl" acts on the armatures 5.

The limiting positioner 14 has a cylindrical portion 26 around which two slip rings 27, 28 are arranged and an insulation is held between the slip rings 27, 28. Brushes 31, 32 are carried by a brush holder 29 and continuously contact with the slip rings 27, 28 respectively. The brush holder 29 is supported by a fixing member not shown and the brushes 31, 32 are connected to a control device 9. The slip rings 27, 28 are connected to the electromagnet coils 23.

The control device 9 controls the electromagnet coils 23 of the electromagnet 7 on the basis of vehicle running condition including an operation speed of engine, a load of engine and so forth. When the operation speed of engine is low and the load of engine is high, the control device 9 energizes the electromagnet coils 23.

When the operation speed of engine is low and the load of engine is low, or when the operation speed of engine is high and the load of engine is low or when the operation speed of engine is high and the load of engine is high, the control device 9 does not energize the electromagnet coils 23 of the electromagnet 7. The pulley 8 is rotationally driven by the crank shaft of engine through the toothed belt 3. The intake cam shaft 1 drives intake valves and a torque for driving the intake valves is transmitted to the sleeve 6. Since the electromagnet 7 is not energized and the sleeve 6 is biased by the torque for driving the intake valves, the sleeve 6 rotatable on the pulley 8 within the predetermined angle of $\alpha$ rotates behind the pulley 8 by the predetermined angle of $\alpha$ at the position shown by the broken line A of FIG. 2.

When the operation speed of engine is low and the load of engine is high, the control device 9 energizes all of the electromagnet coils 23 of the electromagnet 7 through the brushes 31, 32 and through the slip rings 27, 28 and magnetic field is generated in the iron cores 22 as shown by a continuous line D of FIG. 2. Therefore, the armatures 5 are drawn toward the iron cores 22 respectively and the sleeve 6 moves in the pulley 8 from the position indicated by the broken line A to the position indicated by the continuous line B as shown in FIG. 2.

When a magnetic potential difference of gaps g between the armatures 5 and the iron cores 22 is Ug, a permeance of the gaps g is Pg, and a magnetic energy of the gaps g is Wm, Wm is calculated in a following formula.

$$Wm=(\tfrac{1}{2}) * Ug * Pg$$

When a torque for the armatures 5 is T, T is calculated in a following formula.

$$T=\partial Wm/\partial\theta=(\tfrac{1}{2})*Ug^2* dPg/d\,\theta$$

($\theta$: rotational angle of the armatures 5 in relation to the iron cores 22)

When a number of poles of the electromagnet 7 is n, a magnetic potential difference of gap is (NI)g, a space permeability is $\mu 0$, a distance between the rotational center of the sleeve 6 and the outer periphery of the armatures 5 is r and a depth of the armatures 5 and the iron cores 22 is L, the above formula is converted to a following formula.

$$\begin{aligned} T &= n*(\tfrac{1}{2})*[(NI)g]^2* dPg/d\,\theta \\ &= n*(\tfrac{1}{2})*[(NI)g]^2*\mu 0rL/g \end{aligned} \quad (1)$$

When a magnetic flux is $\Phi$, a magnetic reluctance is Rg, a relative permeability is $\mu r$ and a cross-sectional area is A, (NI)g is calculated in a following formula.

$$(NI)g=\Phi Rg=\mu ONI\div(1/\mu rA+g/r\theta L)*g/\mu Or\theta L \quad (2)$$

When the formula (1) is substituted in the formula (2), a following formula is obtained.

$$T=n\mu Og(NI)^2/2rL*1/[(1/\mu rA+g/r\theta L)^2*\theta^2]$$

Since the relative permeability $\mu r$ is large when (NI) is small, $1/\mu rA=0$.

Therefore, the above formula is converted to $$T=n\mu OrL\,(NI)^2/2g$$

T is not changed with $\theta$.

Since the relative permeability $\mu r$ is small when (NI) is large, $$1/\mu rA\neq 0$$

Therefore, $$\begin{aligned} T &= n\mu 0g\,(NI)^2/2rL*1/[(1/\mu rA+g/r\theta L)^2*\theta^2] \\ &= n\mu 0g\,(NI)^2/2rL*1/[(1\theta/\mu rA)^2+21g\theta/\mu rAr1+(g/rL)^2] \end{aligned}$$

The larger $\theta$ is, the smaller the torque T is.

Figure 9:
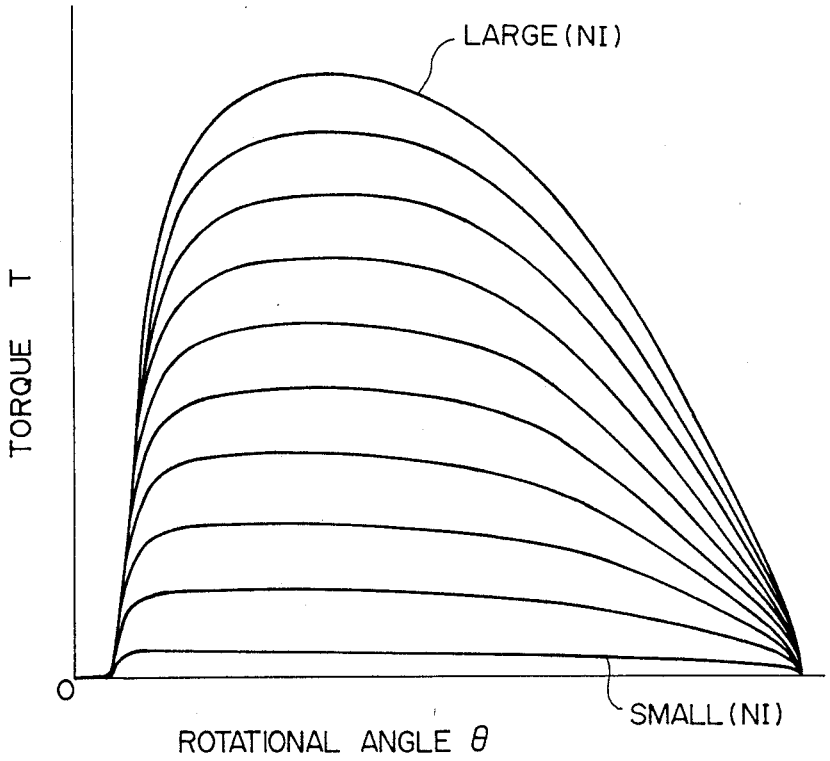
FIG. 9 is a diagram showing relations among the angle of rotation of the armature, the torque for rotating the armature and the magnetic flux generated by the electromagnet.

On the basis of the above formulas, FIG. 9 shows relations among the rotational angle $\theta$ of the armatures 5, the torque T and the magnetic potential difference of gaps (NI)g.

In this embodiment, when the sleeve 6 is rotated on the pulley 8, the frictional force is generated only by the two bearings 16, 17. Therefore, a loss of energy is small and the durability is increased in the valve timing adjuster according to the present invention in comparison with the conventional valve timing adjuster in which the helical teeth are employed and a large frictional force is generated.

And since the armatures 5 are drawn by the energized electromagnet 7 and the armatures 5 begin to move from the position indicated by the broken line A to the position indicated by the continuous line B simultaneously with energizing the electromagnet 7, a response lag which is needed in the conventional valve timing adjuster including the hydraulically-operated actuator is not needed. Therefore, the response speed is improved.

And since the valve timing adjuster according to the present invention does not include a hydraulically-operated actuator, pipe lines for supplying working oil from an oil-source to the hydraulically-operated actuator of the valve timing adjuster 4 is not needed Therefore, a cost for producing an engine is low.

And since the valve timing adjuster according to the present invention does not include the hydraulically-operated actuator, there is not a leak of working fluid from the valve timing adjuster 4. Therefore, a rubber toothed belt is not damaged by the working oil and can be used as the toothed belt 3 for driving the pulley 8.

Figure 10:
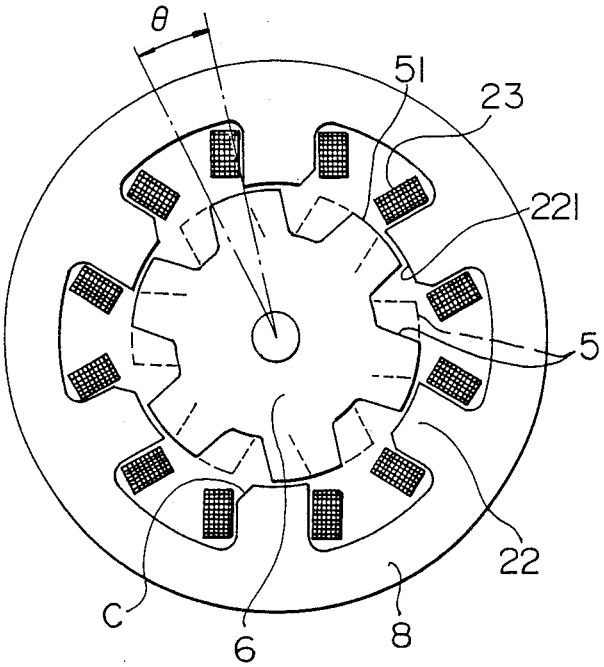
FIG. 10 is a side view showing an arrangement of armature and electromagnet used in another embodiment of the present invention.
Figure 11:
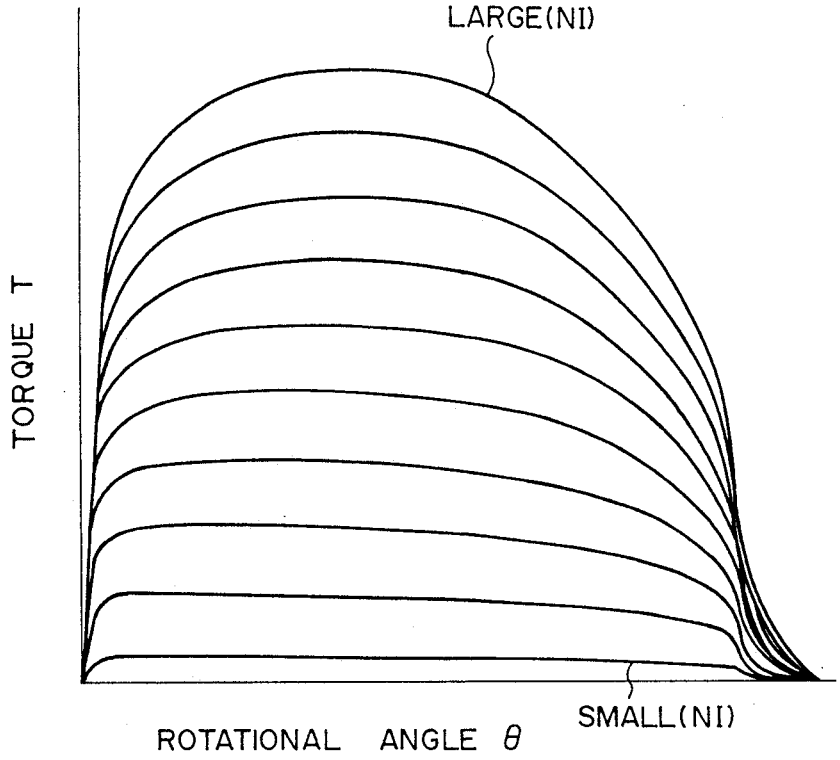
FIG. 11 is a diagram showing relations among the angle of rotation of the armature, the magnetic flux generated by the electromagnet and the torque for rotating the armature in another embodiment of the present invention.

FIGS. 10 and 11 show another second embodiment of the present invention. In each of actuator pairs formed by the iron cores 22 and the armatures 5 respectively, the iron core 22 has a chamfer C thereon, and a chamfer surface of the iron core 22 of that actuator pair does not face the armature 5 of that actuator pair but faces the armature 5 of another neighboring actuator pair.

Since the chamfer surface of the iron core 22 of that actuator pair does not face the armature 5 of that actuator pair but faces the armature 5 of another neighboring actuator pair, a difference between the magnetic reluctance between the iron core 22 of that actuator pair and the armature 5 of that actuator pair and the magnetic reluctance between the iron core 22 of that actuator pair and the armature 5 of the another neighboring actuator pair is sufficiently large so that the iron core 22 of that actuator pair draws only the armature 5 of that actuator pair and the iron core 22 of that actuator pair does not draw the armature 5 of the another neighboring actuator pair when the electromagnet coils are energized. Therefore, particularly when the armatures 5 begin to be drawn by the magnetized iron cores 22, the torque for moving the armatures 5 is large.

And since the magnetic flux is concentrated at the gap g formed between the iron core 22 of that actuator pair and the armature 5 of that actuator pair, the magnetic flux density B is increased. The magnetic potential difference (NI) g of the gap g is calculated with a following formula.

$$\begin{aligned}(NI)g &= \Phi Rg = NI/(1/\mu A + g/\mu 0Ag)*g/\mu 0Ag \\ &= NI/(1 + \mu 0Ag1/\mu Ag)\end{aligned}$$

Therefore, $$T=n*(\tfrac{1}{2})[(NI)g]^2*dPg/d\theta=n/2*[NI/(1+Agl/\mu rAg)]^2*\mu 0/g*(dAg/d\theta)$$

When Ag is replaced by $r\theta L$, $$T=n\mu OrL/2g*[NI/(1+Agl/\mu rAg)]^2$$

Since relative permeability $\mu r$ is large when (NI) is small, $$Agl/\mu rAg=0$$

Therefore, $$T=n\mu OrL(NI)^2/2g$$

The torque T is not changed by $\theta$.

While the relative permeability $\mu r$ is small when (NI) is large, the Ag is decreased by the chamfers C. Therefore, a change in $Agl/\mu rAg$ is smaller than a change in $\mu r$.

And since the area of the electromagnet front surfaces 221 are small in comparison with the amount of magnetic flux generated by the electromagnet, the difference between the generated magnetic flux density and the saturation magnetic flux density is small on the electromagnet front surface. Therefore, a part of the generated magnetic flux flows through a part of the iron cores 22 of electromagnet other than the electromagnet front surface 221 extending in the circumferential direction of the valve timing adjuster and the smaller the difference between the generated magnetic flux density and the saturation magnetic flux density is on the electromagnet front surface 221, the greater the amount of magnetic flux flowing through the part of the iron cores 22 of electromagnet other than the armature front surface is, so that the amount of magnetic flux including a magnetic flux component extending not in the radial direction of the valve timing adjuster but in the circumferential direction of the valve timing adjuster is increased and the amount of magnetic flux extending in the radial direction of the valve timing adjuster between armature front surfaces 51 and the electromagnet front surfaces 221 is decreased.

Therefore in comparison with the first embodiment, a torque for rotating the sleeve is held large even when the sleeve and the pulley move in close to each other in the circumferential direction.

When the armature front surfaces 51 overlap large portions of the electromagnet front surfaces 221, the magnetic potential difference of the gap changes little. Therefore, the torque T becomes nearly 0.

On the basis of the above analysis, FIG. 11 shows relations among the rotational angle of the armatures 5, the torque T and the amount of (NI). In the characteristics of torque shown in FIG. 11, when the rotational angle of the armatures 5 is small, the rising degrees of torque are large, and even when the rotational angle of the armatures 5 is large, the torque is held large, in comparison with the characteristics of torque shown in FIG. 9.

Therefore, the rotational angle in which the armatures 5 of the second embodiment are drawn by more than a predetermined torque is larger than the rotational angle in which the armatures 5 of the first embodiment are drawn by more than the predetermined torque, so that the adjustable range for adjusting the valve timing in accordance with the condition of engine can be increased.

A circumferential length of the chamfers C is preferably one-third to one-sixth of the circumferential length of each of the armatures 5 and the iron cores 22.

Figure 12:
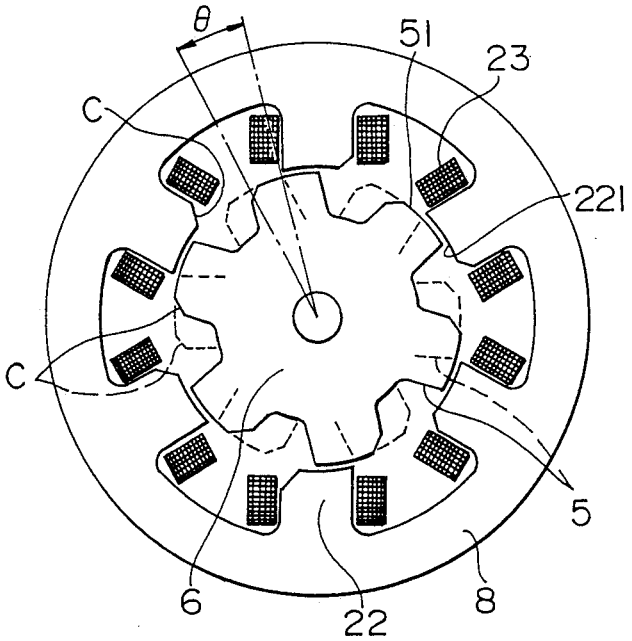
FIG. 12 is a side view showing an arrangement of armature and electromagnet used in the other embodiment of the present invention.

In FIG. 12 showing a third embodiment of the present invention, in each of actuator pairs formed by the iron cores 22 and the armatures 5 respectively, the iron core 22 has a chamfer C thereon and the armature 5 has also a chamfer C, and a chamfer surface of the iron core 22 of that actuator pair does not face the armature 5 of that actuator pair but faces the armature 5 of another neighboring actuator pair and a chamfer surface of the armature 5 of that actuator pair does not face the iron core 22 of that actuator pair but faces the iron core 22 of the other neighboring actuator pair. A circumferential length of the chamfers C of this embodiment is smaller than that of the second embodiment.

Figure 13:
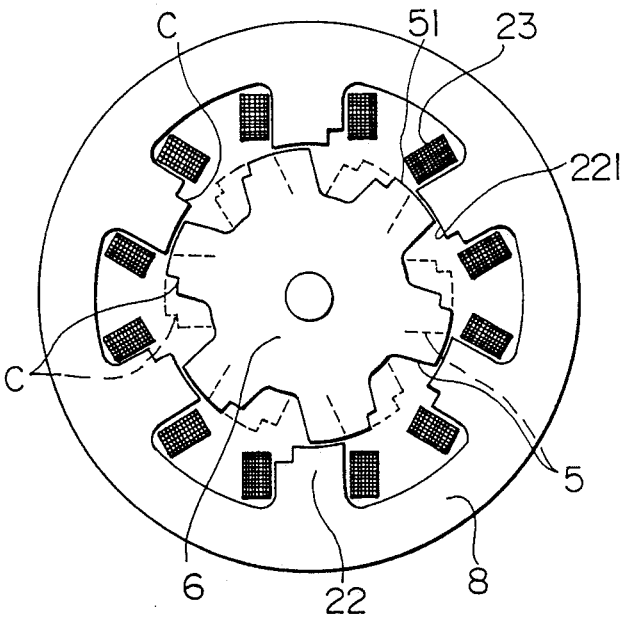
FIG. 13 is a side view showing an arrangement of armature and electromagnet used in the other embodiment of the present invention.

In FIG. 13 showing a fourth embodiment of the present invention, the chamfers C employed in the second and third embodiments are replaced by step-shaped grooves. The same effect as the second and third embodiments are obtained by this embodiment.

As an alternative embodiment, in each of actuator pairs formed by the iron cores 22 and the armatures 5 respectively, only the armature 5 may have the chamfer C, the surface of which of that actuator pair does not face the iron core 22 of that actuator pair but faces the iron core 22 of the another neighboring actuator pair.

As another alternative embodiment, the brushes 31, 32 may arranged inside of the slip rings 27, 28 to contact with the inner peripheries of the slip rings 27, 28.

As the other alternative embodiment, the disk-shaped slip ring may be employed, and the brushes 31, 32 contact with electric intake portions of the disk-shaped slip ring.

As the other alternative embodiment, the rolling bearings 16, 17 for supporting the pulley 8 on the sleeve 6 may be replaced by bushes (metal bearings).

As the other alternative embodiment, the sleeve 6 may formed integrally with the cam shaft.

As the other alternative embodiment, materials other than metal materials may be arranged at colliding portions between the rotation preventing positioner 12 and the limiting positioner 14 so that colliding force and colliding noise are decreased and vibration caused by backlash is absorbed.

As the other alternative embodiment, the rotation preventing positioner 12 or the limiting positioner 14 may be formed integrally with the sleeve 6 or the pulley 8.

As the other alternative embodiment, the valve timing adjuster according to the present invention may be connected to the outlet cam shaft to change phase difference between the crank shaft and the outlet cam shaft.

As the other alternative embodiment, the valve timing adjuster according to the present invention may be connected to the crank shaft or to a cam shaft of single cam engine.

As the other alternative embodiment, the sleeve 6 and the pulley 8 may be opposed to each other in the axial direction, or the electromagnet 7 and the armatures 5 may be opposed to each other in the axial direction.

What is claimed is:

1. A valve timing adjuster comprising, a pulley connected to one of an output shaft of engine and a cam shaft, a sleeve which is rotatable coaxially relative to the pulley within a predetermined angle of rotation relative to the pulley and is connected to the other one of the output shaft of engine and the cam shaft, an electromagnet mounted on one of the pulley and the sleeve, at least one armature mounted on the other one of the pulley and the sleeve so that magnetic flux including a magnetic flux component extending in the circumferential direction of the valve timing adjuster is generated, the armature is drawn by the generated magnetic flux toward the electromagnet and the sleeve is rotated within the predetermined angle of rotation relative to the pulley when the electromagnet is energized, and a control device which controls the operation of the electromagnet so that the phase difference between the cam shaft and the output shaft is suitably adjusted during operation of a vehicle.

2. A valve timing adjuster according to claim 1, wherein, the armature has at least one armature front surface extending in the circumferential direction of the valve timing adjuster and the electromagnet has at least one electromagnet front surface extending in the circumferential direction of the valve timing adjuster, the armature front surface and the electromagnet front surface face closely to each other in the radial direction of the valve timing adjuster, and the area of at least one of the armature front surface and the electromagnet front surface is small in comparison with the degree of magnetic flux generated by the electromagnet so that a difference between the generated magnetic flux density and the saturation magnetic flux density is small on at least one of the armature front surface and the electromagnet front surface and a part of magnetic flux including a magnetic flux component extending not in the radial direction of the valve timing adjuster but in the circumferential direction of the valve timing adjuster is increased.

3. A valve timing adjuster according to claim 1, wherein, the armature has at least one armature front surface extending in the circumferential direction of the valve timing adjuster and the electromagnet has at least one electromagnet front surface extending in the circumferential direction of the valve timing adjuster, the armature front surface and the electromagnet front surface face closely to each other in the radial direction of the valve timing adjuster, and in each actuator pair formed by the armature and the electromagnet, the armature has a chamfer on the armature front surface, a chamfer surface of the armature of that actuator pair does not face the electromagnet of that actuator pair but faces the electromagnet of another neighboring actuator pair.

4. A valve timing adjuster according to claim 1, wherein, the armature has at least one armature front surface extending in the circumferential direction of the valve timing adjuster and the electromagnet has at least one electromagnet front surface extending in the circumferential direction of the valve timing adjuster, the armature front surface and the electromagnet front surface face closely to each other in the radial direction of the valve timing adjuster, and in each actuator pair formed by the armature and the electromagnet, the electromagnet has a chamfer on the electromagnet front surface, a chamfer surface of the electromagnet of that actuator pair does not face the armature of that actuator pair but faces the armature of another neighboring actuator pair.

5. A valve timing adjuster according to claim 1, wherein, the armature has at least one armature front surface extending in the circumferential direction of the valve timing adjuster and the electromagnet has at least one electromagnet front surface extending in the circumferential direction of the valve timing adjuster, the armature front surface and the electromagnet front surface face closely to each other in the radial direction of the valve timing adjuster, and in each actuator pair formed by the armature and the electromagnet, the armature has a step-shaped groove at the armature front surface, a step-shaped groove surface of the armature of that actuator pair does not face the electromagnet of that actuator pair but faces the electromagnet of another neighboring actuator pair.

6. A valve timing adjuster according to claim 1, wherein, the armature has at least one armature front surface extending in the circumferential direction of the valve timing adjuster and the electromagnet has at least one electromagnet front surface extending in the circumferential direction of the valve timing adjuster, the armature front surface and the electromagnet front surface face closely to each other in the radial direction of the valve timing adjuster, and in each actuator pair formed by the armature and the electromagnet, the electromagnet has a step-shaped groove at the electromagnet front surface, a step-shaped groove surface of the electromagnet of that actuator pair does not face the armature of that actuator pair but faces the armature of another neighboring actuator pair.

7. A valve timing adjuster according to claim 1, comprising, a rotation preventing positioner being attached to an end of the sleeve and having a fan-shaped portion, and a limiting positioner 14 being attached to an end of the pulley and having a notch portion whose angle is larger than an angle of the fan-shaped portion received by the notch portion.

8. A valve timing adjuster according to claim 1, wherein, the electromagnet is mounted on the pulley, the pulley has a cylindrical portion at an end thereof and has slip rings arranged on the cylindrical portion, and the slip rings contact with brushes for supplying electric energy.

9. A valve timing adjuster according to claim 1, wherein, a plurality of the armatures extend radially, and the electromagnet includes iron cores a number of which is identical with that of the armatures.

10. A valve timing adjuster according to claim 1, wherein, the control device controls the operation of electromagnet in accordance with the operation speed and load of engine so that the sleeve rotates on the pulley and is pressed against one end of a movable range of the sleeve.

11. A valve timing adjuster, comprising, a pulley connected to one of an output shaft of engine and a cam shaft, a sleeve, a rotational axis of which is identical with a rotational axis of the pulley and which is rotatable within a predetermined angle of rotation relative to the pulley and is connected to the other one of the output shaft of engine and the cam shaft, and magnetic flux generating means, wherein, a component of the magnetic flux generated by the magnetic flux generating means extends between the pulley and the sleeve in the circumferential direction of the valve timing adjuster so that the sleeve rotates relative to the pulley.

* * * * *